US006802335B2

(12) United States Patent
Jones et al.

(10) Patent No.: US 6,802,335 B2
(45) Date of Patent: Oct. 12, 2004

(54) FAUCET HANDLE RETAINER

(75) Inventors: Scott Kevin Jones, Carmel, IN (US); Garry Robin Marty, Fishers, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 0 days.

(21) Appl. No.: 10/349,732

(22) Filed: Jan. 23, 2003

(65) Prior Publication Data

US 2004/0144434 A1 Jul. 29, 2004

(51) Int. Cl.[7] ..... F16K 11/20; F16K 11/22; F16K 31/60

(52) U.S. Cl. ..... 137/315.15; 16/422; 137/606; 137/637.2; 137/637.4; 137/897; 251/291; 251/292; 74/543; 74/548; 403/362

(58) Field of Search ..... 74/543, 548; 16/422; 137/51.17, 15.18, 315.12, 315.13, 315.14, 603, 606, 607, 896, 897, 315.15, 637.2, 637.3, 637.4; 251/291, 292; 403/362

(56) References Cited

U.S. PATENT DOCUMENTS 2,199,129 A * 4/1940 Hamilton ..... 137/607
2,843,150 A * 7/1958 Goodwin ..... 137/637.2
2,847,031 A * 8/1958 Brown, Jr. ..... 137/637.4
2,879,801 A * 3/1959 Cornelius ..... 137/637.2
2,898,938 A * 8/1959 Dombre ..... 137/637.2
2,991,795 A * 7/1961 Fraser et al. ..... 137/244
3,411,541 A * 11/1968 Hindman ..... 137/637.2
3,637,188 A * 1/1972 Ung ..... 137/637.2
3,791,402 A * 2/1974 Shuler ..... 137/315.41
3,812,875 A * 5/1974 Buhler ..... 137/637.2
4,445,529 A * 5/1984 Lagarelli ..... 403/362
4,876,766 A * 10/1989 Cohen ..... 251/292
5,727,590 A * 3/1998 Julicher et al. ..... 251/291

FOREIGN PATENT DOCUMENTS

CA 773872 * 12/1967 ..... 137/637.2

* cited by examiner

*Primary Examiner*—George L. Walton
(74) *Attorney, Agent, or Firm*—Carlson, Gaskey & Olds

(57) ABSTRACT

A faucet assembly includes a first handle attached to rotate a fluid control member and includes a first groove. A second handle is attached to move the fluid control member along a central axis and includes a second groove aligned with the first groove. A retainer ring disposed is movable within the first and second grooves between a release and a secure positions. A biasing member within the second groove biases the retainer toward the release position and a threaded member within the first handle biases retainer toward the secured position. The setscrew moves the retainer from the release position by moving a portion of the retainer from the second groove to the first groove within the first handle.

20 Claims, 4 Drawing Sheets

FAUCET HANDLE RETAINER

BACKGROUND OF THE INVENTION

This invention generally relates to a faucet handle assembly and specifically to a retainer for securing a handle to a faucet assembly.

Typically, a faucet includes a handle to actuate a stem disposed within a faucet housing. The stem rotates or lifts to make water flow between an inlet and an outlet. In some faucet assemblies, two handles are used in conjunction to allow the specific temperature of the water to be set. In such faucet assemblies, a first handle rotates a stem member within the faucet body between an on and an off position. A second handle mounted atop the first handle moves the stem assembly along a central axis to control the temperature. In operation of such a faucet, the top or second handle controls the temperature and is set and left in a desired position. The first handle rotates to controls fluid flow through an outlet. In this manner, the specific desired temperature of the water is maintained and does not require setting or adjustment for each use.

Typically, the known manner of attaching handles to actuate the faucet stem is by a screw in the top of the handle. Other methods include a set screw that is threaded within one of the handle assemblies to engage the stem member. Each of these methods of securing a faucet handle to the stem requires that the attachment screw engage the stem. It is desirable to hide or conceal the attachment screw for cosmetic purposes. For this reason, covers or other devices are used to conceal the screw. However, such covers often fail and over time fade and may come off revealing the screw.

Further, in one specific application using two handles, the temperature control handle raises and lowers or moves axially relative to the on-off handle during temperature adjustment. This is so because the stem member moves along the central axis in order to proportionally control the amount of water from each of the inlets. As appreciated, the space between the on-off handle and the temperature control handle is changed relative to the setting of the temperature control handle. In many cases, the desired setting for the temperature control handle will result in a substantial gap between the on-off handle and a temperature handle. It is desirable to eliminate this gap as it is unsightly and does not present a pleasing appearance to the faucet. Further, the appearance of a gap between the on-off handle and the temperature control handle can be interpreted as a quality flaw or may also be interpreted as an indication that the water is on by a consumer.

Accordingly, it is desirable to provide and develop a means of attaching the temperature control handle to a faucet assembly that allows for the separate temperature adjustment while maintaining the relative position axially between the on-off handle and the temperature adjustment handle. Further, it is also desirable to develop a method of securing and attaching a faucet handle to a faucet assembly without the use of unsightly and esthetically unpleasing screw that is visible in the top of the handle.

SUMMARY OF THE INVENTION

This invention is a faucet assembly including a handle attachment configuration that attaches a second handle to a first handle without the use of threaded members directly engaging an actuation stem. The handle attachment configuration includes a retainer movable within corresponding grooves provided in the first and second handles between a centered release position and an off-centered secured position.

In one embodiment of the faucet assembly a on-off handle includes a first groove disposed about the inner surface of a bore. A second handle includes an extension portion that fits within the bore of the first handle. The second handle includes a second groove that is disposed about the outer surface of the extension and corresponds with the groove on the inner surface of the first handle. Disposed within the second groove on the second handle is a retainer. An o-ring is disposed between the retainer and the second handle. The o-ring biases the retainer toward a centered position in which the entire retainer is disposed within the first groove of the second handle.

The second handle is pushed into the bore of the first handle until the first and second grooves align. A set screw disposed within the first handle is then tightened to push the retainer out of the groove on the second handle and at least partially into a groove on the first handle. In this manner, the retainer is pushed off-center relative to the central axis of the faucet assembly such that a portion of the retainer is disposed within the groove on the first handle and the groove on the second handle. As appreciated, the retainer disposed within both grooves prevents the second handle from being removed from the first handle. This method of securing the second handle to the first handle does not include the use of any screw or any threaded member that meets the faucet stem.

The second handle includes a thread that corresponds to a splined piece attached to the faucet stem member. Rotation of the second handle about the central axis moves the stem member along the axis to provide for adjustment of fluid flow through each of two inlets. As appreciated, the inlets correspond to hot and cold water to provide a specific desired temperature setting. The temperature setting is set independent of on-off regulation of water through the outlet.

Accordingly, this invention secures a handle to actuate a stem assembly without threaded members on visible portions of the assembly and maintains the space between first and second handles regardless of the specific temperature setting.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
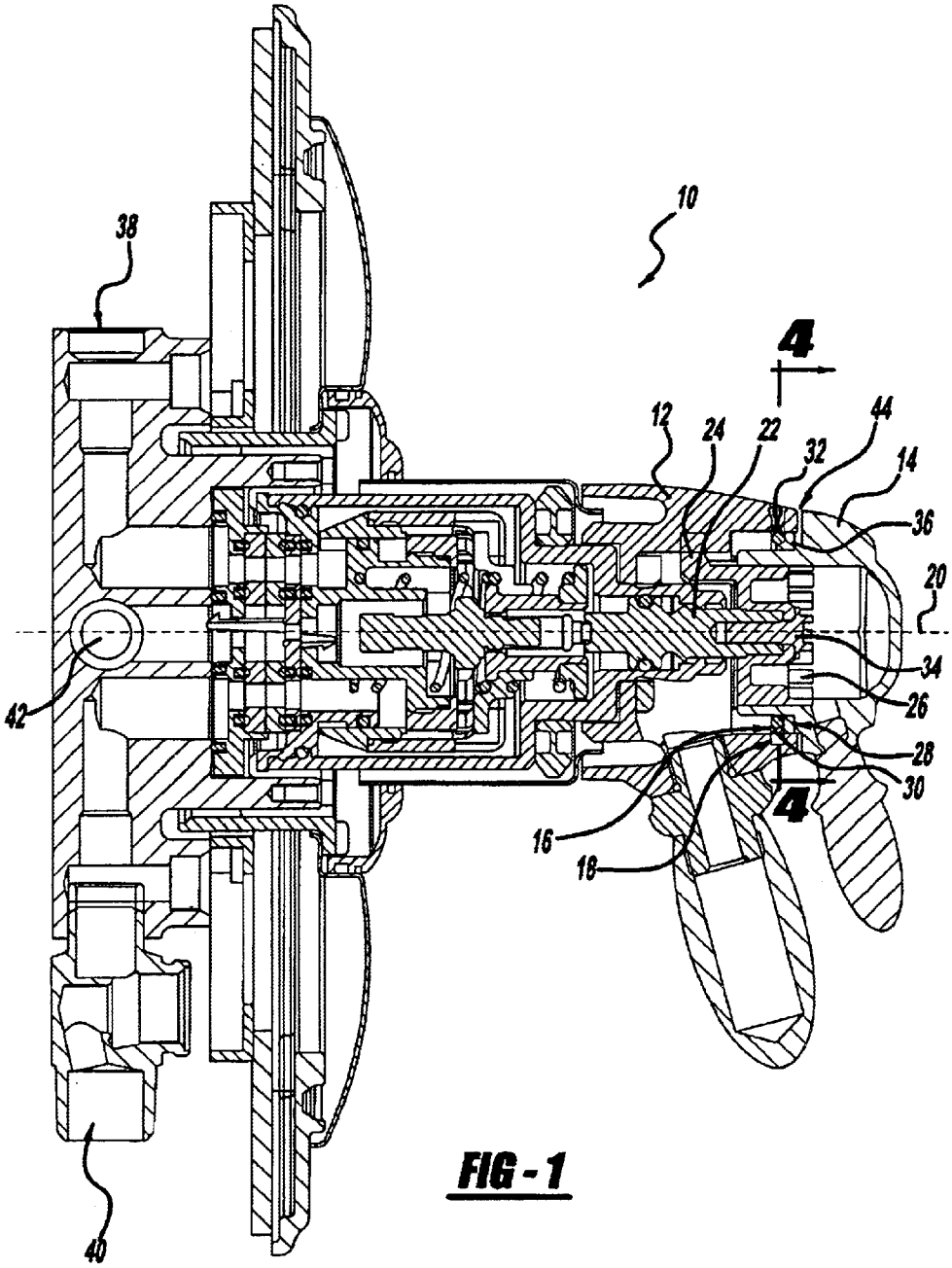
FIG. 1 is a cross-sectional view of a faucet assembly.

Referring to FIG. 1, a faucet assembly 10 includes a handle configuration that attaches a second handle 14 to a first handle 12 without the use of threaded members directly engaging an actuation stem 22. The first handle 12 controls the flow of fluid through an outlet 40. The second handle 14 attaches to the first handle 12 and rotates about a central axis 20. Rotation of the second handle 14 controls the proportion of fluid flow of from each inlet 38,40 to the outlet 40. The second handle 14 controls fluid temperature flowing to the outlet by proportionally controlling fluid flow from each of the inlets 38, 40. The second handle 14 is held onto the first handle 12 by a retainer ring 30 disposed within concentric grooves 16 and 18. The retainer ring 30 is pushed off center such that a portion of the retainer ring 30 is positioned within each of the grooves 16 and 18. The retainer ring 30 is biased toward this off center position by a setscrew 32 threaded into the first handle 12. No threaded members are required for mounting the second handle 14 directly to an actuation stem 22.

O-ring 28 is disposed between the retainer 30 and the handle 14 within the groove 16. The o-ring 28 biases the retainer 30 toward a center or release position. In the centered position retainer 30 is entirely disposed within the groove 16 of the second handle 14. The centered position provides for removal of the second handle 14 from the first handle 12. As appreciated, although o-ring 38 is illustrated, it is within the contemplation of this invention that other biasing members, such as springs, washers or rubber seals may also be used to bias the retainer ring 30 toward the centered or release position.

The faucet assembly 10 illustrated operates using the first handle 12 to turn on and off water, and the second handle 12 to set a desired water temperature. The first handle 12 rotates about the central axis 20 and is engaged to the stem 22. The stem 22 rotates to selectively control water flow through the outlet 42. The second handle 14 rotates about the central axis 20 and moves the stem 22 along the axis 20 such that flow is proportionally controlled between the two outlets 38,40. Controlling the proportion of fluid from each of the inlets 38,40 sets the desired fluid temperature.

The second handle 14 includes a threaded section 26 that corresponds with a splined section 24 mounted to the stem 22. The splined portion 24 operates to move the stem 22 along the axis 20 in response to rotation of the second handle 14. Rotation of the second handle 14 selectively moves the stem 22 upward or downward along the axis 20 to proportionally control fluid from each inlet 38, 40 into the faucet assembly 10.

A space 44 between the first handle 12 and second handle 14 remains constant regardless of the setting of the second handle 14. The space 44 between the first and second handles 12, 14 is maintained because the retainer ring 30 prevents relative axial movement between first and second handles 12, 14. Maintaining a constant spacing between first and second handles 12, 14 improves the aesthetic appearance of the faucet assembly 10.

Figure 2:
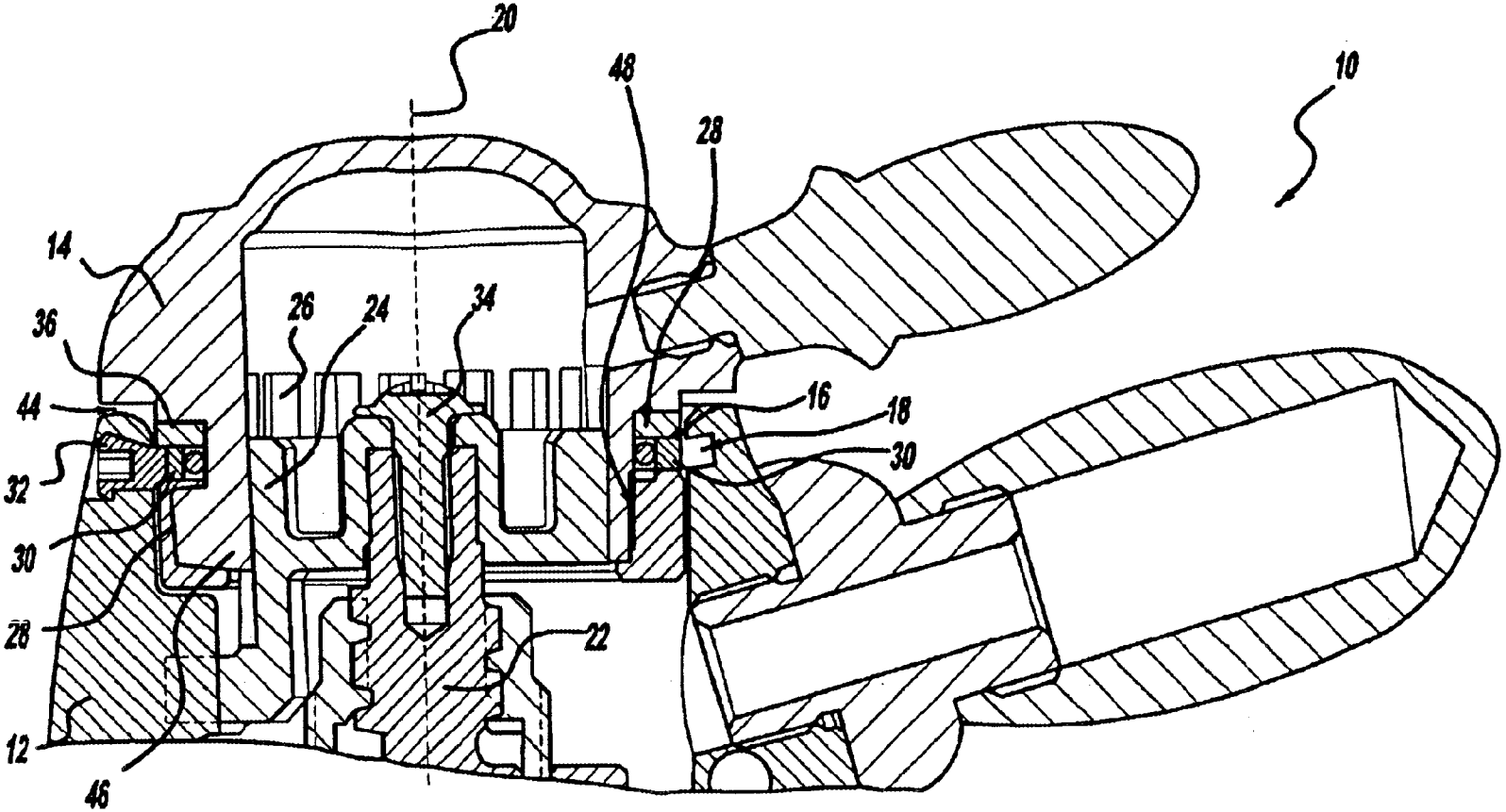
FIG. 2 is a cross-sectional view of the faucet assembly with a retainer in a release position.
Figure 3:
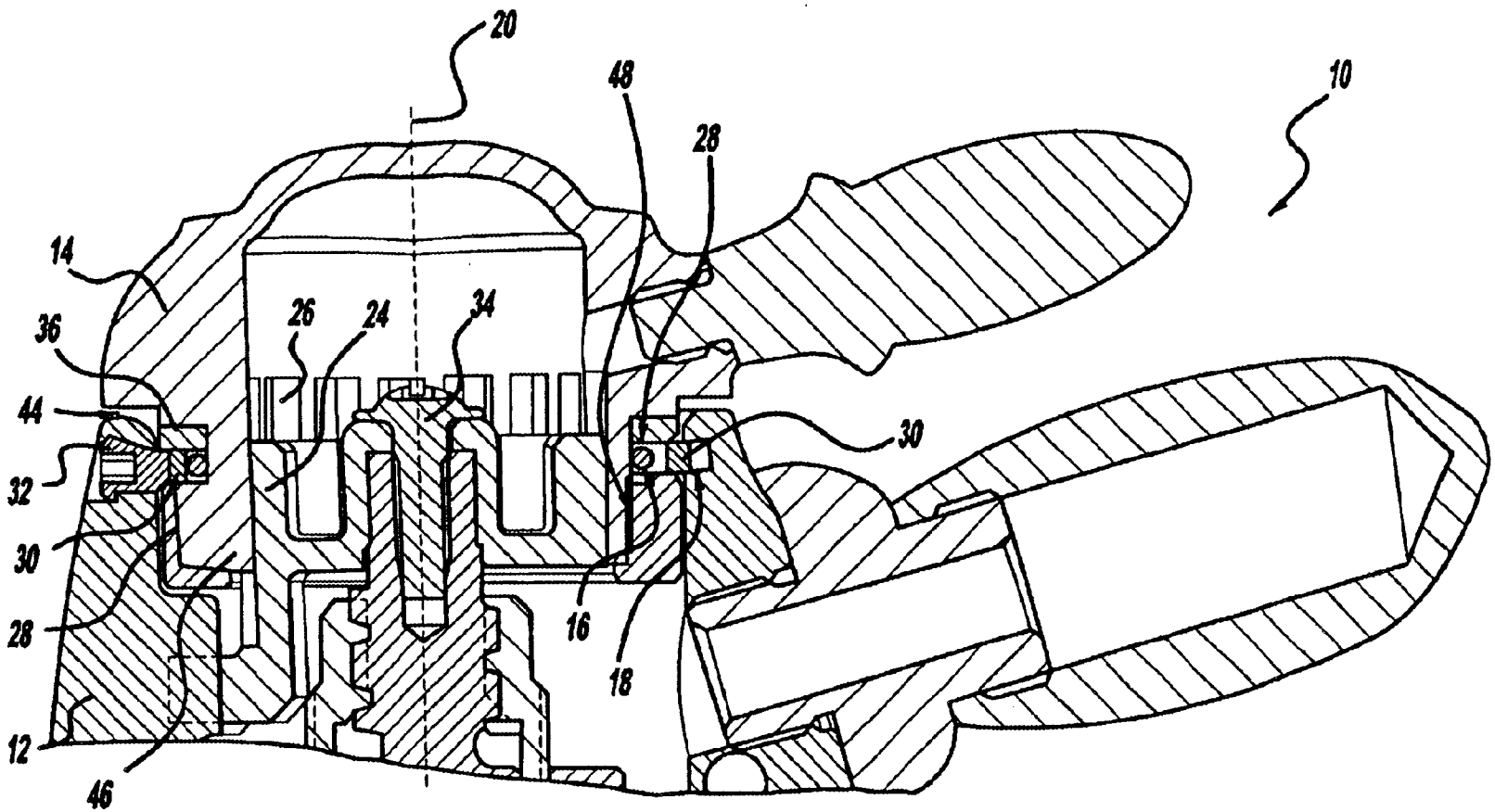
FIG. 3 is a cross-sectional view of the faucet assembly with the retainer in a secured position.
Figure 4:
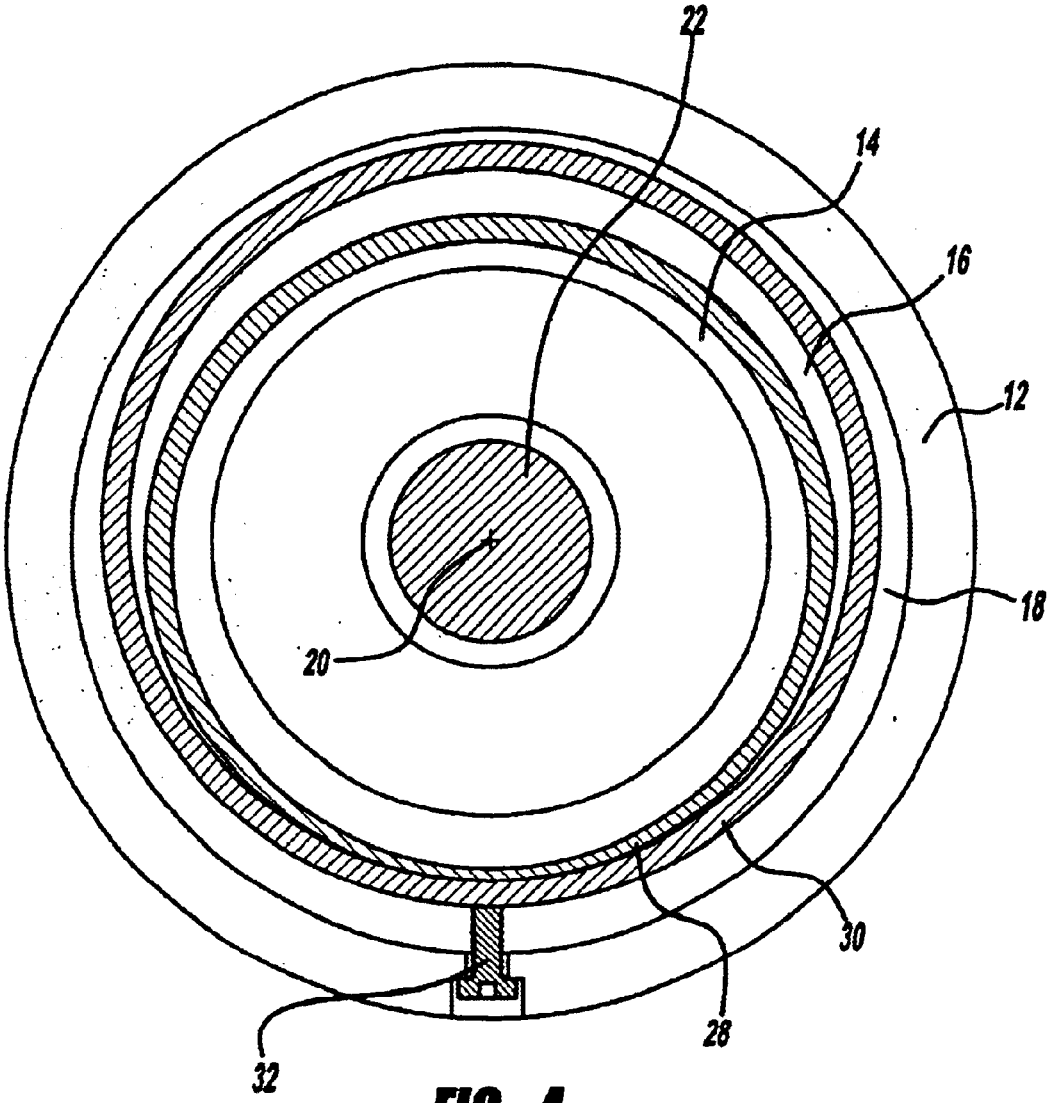
FIG. 4 is a cross-sectional view along the central axis through the retainer.

Referring to FIGS. 2–4, the faucet assembly 10 includes the first and second grooves 16, 18. The grooves 16, 18 correspond and are concentric with each other about the axis 20. The first handle 12 is held onto the stem 22 by way of the fastening member 34. The fastening member 34 is as known by a worker skilled in the art. The fastening member 34 holds a spline portion 24 onto the stem 22. The first handle 12 rotates the stem 22 about the axis 20. The splined portion 24 corresponds to the splined portions 26 of the second handle 14. The splined portions 26 rotate relative to the splined portions 24 such that rotation of the second handle 14 moves the stem 22 axially.

The first and second grooves 16, 18 align providing a corresponding groove for movement of the retainer ring 30 between release and secured positions. The second handle 14 is secured to the first handle 12 by inserting an extension portion 46 of the second handle 12 into a bore 48 defined by the first handle 12. The second handle 14 inserts into the second handle 12 such that the grooves 16 and 18 align. The setscrew 32 extends from the first handle 12 into the groove 18 and contacts the retainer 30. The set screw 32 biases the retainer ring 30 such that a portion of the retainer ring 30 enters the second groove 18 of the first handle 12. In a secured position at least a portion of the retainer ring 30 is disposed both within the groove 16 of the second handle 14 and the groove 18 of the first handle 12. The retainer 30 is disposed partially within both of the grooves 16 and 18 in an off-center position. The off-center position of the retainer ring 30 prevents the handle 14 from being pulled free of the first handle 12.

A bushing 36 is disposed above the retainer 18 and eases rotation of the second handle 14 relative to the first handle 12. FIG. 2 illustrates the retainer 30 in a released position where the entire retainer ring 30 is disposed within the groove 16. Because the retainer 30 is free of the groove 18, the handle 12 is free to be removed from the first handle 12.

Referring to FIG. 3, the retainer 30 is shown in the secured position. In the secured position, at least a portion of the retainer 30 is disposed within the second groove 18. The setscrew 32 is tightened into the first handle 12 such that it compresses the o-ring 28. The o-ring 28 is compressed between the retainer ring 30 and the handle 14. The setscrew 32 is recessed below the surface of the first handle 12. When it is desired to remove the handle 14, the setscrew 32 is unthreaded allowing the o-ring 28 to bias the retainer ring 30 toward the release position. The biasing member 28 biases against the set screw 32 such that when the biasing force of the set screw 32 is released, the retainer ring 30 is pulled out of the groove 18 and back into and centered within the groove 16 of the second handle 14.

Referring to FIG. 4, the retainer ring 30 is shown in the secured position off set relative to the central axis 20. The setscrew 32 is threaded through the second groove 18 into the first groove 16 to contact the retainer ring 30. The retainer ring 30 is pushed toward the second handle 12 to compress the o-ring 28 and move a portion of the retainer ring 30 into the second groove 18 on a side opposite the setscrew 32. The retainer ring 30 is preferably of a rectangular cross-section to present a flat surface toward each of the grooves 16, 18 in order to prevent axial movement of the second handle 14 relative to the first handle 14. Further, preferably, the retainer ring 30 is fabricated of a material compatible with fluids. It is within the contemplation of this invention to use any material known in the art for fabrication of the retainer ring 30. Further, although the retainer is illustrated as a ring, other shapes such as oval, or rectangular are also within the contemplation of this invention.

Referring to FIG. 1, in operation, the first handle 12 is affixed to the stem 22 by way of the threaded member 34. The threaded member 34 holds the handle 12 along with the splined portion 24 onto the stem 22. The first handle 12 rotates about the axis 20 to control flow of fluid through the outlet 42. The second handle 14 is then assembled to the faucet assembly 10 by simply inserting the extension portion 46 within the bore 48 defined by the first handle 12. The extension portions 46 include the groove 16. Within the groove 16 is the o-ring 28 and retainer ring 30. The o-ring 28 is disposed between the retainer ring 30 and the extension portions 46. The o-ring 28 centers the retainer ring 30 within the groove 16. Without the o-ring 28, once the set screw 32 has moved the retainer ring 30 into the groove 18, it would remain their with no means of biasing the retainer ring 30 back into the groove 16 for removal of the second handle 14.

The second handle 14 includes corresponding spline portions 26 that correspond to the spline portions 24 on the stem portion 22. Rotation of the second handle 14 causes movement of the spline portion 24 or the stem 22 along the axis 20. The spline portions 24 and 26 mount to cause axial movement of the stem 22. Preferably, the spline portions 24 and 26 include a mating threaded surface that facilitates the axial movement of the stem 22. Although a threaded surface is preferable, other configurations as are known to a worker skilled in the art for moving the stem portion 22 axially is within the contemplation of this invention.

Further, although application of this invention is illustrated with a two-handle faucet assembly, this invention may also be applied to other configuration of faucet assemblies including only a single handle for control of fluid flow.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A faucet assembly comprising:

a base member including a first groove;

a handle including a second groove corresponding with said first groove in said base member;

a retainer movable within said first and second grooves between a secured position and a release position;

a biasing member abutting said retainer and biasing said retainer toward said release position, and a threaded member movable into abutment with said retainer for driving said retainer against said biasing member toward said secured position wherein said base member and said handle are releasably secured to one another.

2. The assembly of claim 1, wherein said retainer is movable within said first and second grooves from said release position where said retainer is disposed within said second groove, and said secured position, where at least a portion of said retainer is disposed within each of said first and second grooves.

3. The assembly of claim 1, wherein said biasing member is positioned between said retainer and said handle within said second groove.

4. The assembly of claim 1, wherein said base member includes a bore and said first groove is disposed about an inner surface of said bore.

5. The assembly of claim 4, wherein said handle includes an extension for mounting within said bore and said second groove is disposed about an outer surface of said extension.

6. The assembly of claim 1, wherein said base member is movable relative to said handle.

7. The assembly of claim 1, wherein said handle is engaged to a fluid control member such that actuation of said handle controls the flow of fluid.

8. The assembly of claim 7, wherein said handle rotates relative to said base member.

9. The assembly of claim 7, wherein rotation of said handle selectively raises and lowers said fluid control member.

10. The assembly of claim 1, wherein said base member is rotatable for proportionally controlling fluid flow from a first and second fluid inlet.

11. The assembly of claim 1, wherein said handle is rotatable to control fluid flow through an outlet.

12. A faucet assembly comprising:

a base member including a first groove;

a handle rotatable relative to said base member and including a second groove corresponding with said first groove in said base member;

a retainer movable within said first and second grooves between a secured position and a release position;

a biasing member abutting said retainer and biasing said retainer toward said release position;

a threaded member movable into abutment with said retainer for driving said retainer against said biasing member toward said secured position, wherein said base member and said handle are releasably secured to one another, and a fluid control member engaged to said handle such that actuation of said handle controls the flow of fluid, wherein rotation of said handle selectively raises and lowers said fluid control member and wherein rotation of said base member rotates said fluid control member.

13. A faucet assembly comprising:

a base member including a first groove;

a handle including a second groove corresponding with said first groove in said base member;

a retainer movable within said first and second grooves;

a biasing member abutting said retainer for biasing said retainer toward a release position; and a threaded member movable into abutment with said retainer opposite said biasing member for driving said retainer toward said secured position, wherein said base member and said handle are releasably secured to one another, and said threaded member is disposed within said base member and extends into said first groove.

14. The assembly of claimed 13, wherein said threaded member is disposed within a bore of said base member.

15. A faucet assembly comprising:

a base member including a first groove;

a handle including a second groove corresponding with said first groove in said base member;

a retainer movable within said first and second grooves;

a biasing member abutting said retainer for biasing said retainer toward a release position, and a threaded member movable into abutment with said retainer for driving said retainer toward a secured position, wherein said base member and said handle are releasably secured to one another and said retainer is a ring disposed within said second groove and said biasing member is disposed between an inner diameter of said ring and a diameter of said second groove.

16. A faucet assembly comprising:

a first handle attached to rotate a fluid control member and including a first groove;

a second handle attached to move said fluid control member along a central axis, and said second handle includes a second groove corresponding with said first groove in said first handle;

a retainer movable within said first and second grooves;

a biasing member abutting said retainer and biasing said retainer toward a release position, and a threaded member movable into abutment with said retainer for driving said retainer against said biasing member toward a secured position, wherein said first handle and said second handle are releasably secured to one another.

17. The assembly of claim 16, wherein said first handle rotates said fluid control member between an open and closed position.

18. The assembly of claim 16, wherein said second handle rotates relative to said first handle and proportionally controls fluid flow from first and second fluid inlets.

19. The assembly of claim 18, wherein said second handle includes an internal thread engaged to said fluid control member such that rotation of said second handle moves said fluid control member along said central axis.

20. The assembly of claim 18, wherein said threaded member moves said retainer from said release position wherein said retainer is disposed within said second groove, to said secured position where at least a portion of said retainer is disposed within each of said first and second grooves.

* * * * *